US007201509B2

(12) United States Patent
Erber

(10) Patent No.: US 7,201,509 B2
(45) Date of Patent: Apr. 10, 2007

(54) LIGHTING UNIT WITH LIGHT SOURCE AND OPTICAL WAVEGUIDE

(75) Inventor: Andreas Erber, Ostfildern (DE)

(73) Assignee: Schefenacker Vision Systems Germany GmbH, Schwaikheim (DE)

( * ) Notice: Subject to any disclaimer, the term of this patent is extended or adjusted under 35 U.S.C. 154(b) by 32 days.

(21) Appl. No.: 10/913,718

(22) Filed: Aug. 6, 2004

(65) Prior Publication Data

US 2005/0063169 A1 Mar. 24, 2005

(30) Foreign Application Priority Data

Aug. 7, 2003 (DE) ..... 103 39 162

(51) Int. Cl.
*F21V 8/00* (2006.01)

(52) U.S. Cl. ..... 362/560; 362/555; 362/296; 362/350

(58) Field of Classification Search ..... 362/555, 362/560, 576, 572, 573, 511, 296, 347, 350
See application file for complete search history.

(56) References Cited

U.S. PATENT DOCUMENTS

| | | | | |
|---|---|---|---|---|
| 5,515,243 | A * | 5/1996 | Cassarly et al. | 362/560 |
| 5,733,028 | A * | 3/1998 | Ramer et al. | 362/552 |
| 6,290,381 | B1 * | 9/2001 | Mangum et al. | 362/554 |
| 6,811,277 | B2 * | 11/2004 | Amano | 362/602 |
| 6,959,995 | B2 * | 11/2005 | Ikarashi et al. | 362/23 |

FOREIGN PATENT DOCUMENTS

DE 199 30 461 1/2001

* cited by examiner

*Primary Examiner*—Laura K. Tso

(57) ABSTRACT

The invention relates to a lighting unit with at least one light source and at least one optical waveguide following the light source, said waveguide having at least one light transmitting surface. To this end, the lighting unit has at least one reflector. In addition, at least one light transmitting surface of the optical waveguide faces the reflector.

A lighting unit with an optical waveguide which has a large illuminated area and requires only a small space is provided.

12 Claims, 3 Drawing Sheets

LIGHTING UNIT WITH LIGHT SOURCE AND OPTICAL WAVEGUIDE

CROSS-REFERENCE TO RELATED APPLICATION

This application claims priority to German Patent Application No. 103 36 162.6 filed on Aug. 7, 2003.

FIELD OF THE INVENTION

The invention relates to a lighting unit with at least one light source and at least one optical waveguide following the light source, said waveguide having at least one light transmitting surface.

BACKGROUND OF THE INVENTION

Such a lighting unit is known from DE 199 30 461 A1. To achieve a large illuminated area, this lighting unit includes a light source followed by two optical waveguides arranged in series. This construction requires a large amount of space.

SUMMARY OF THE INVENTION

The present invention is based on the object of developing a lighting unit with an optical waveguide which has a large illuminated area and requires only a small space.

This object is attained with the features of the main claim. To this end, the lighting unit has at least one reflector. In addition, at least one light transmitting surface of the optical waveguide faces the reflector.

Light rays emitted by the light source are directed through the optical waveguide. The light rays exit the optical waveguide at least through the light transmitting surface facing the reflector. They are reflected at the reflector and emitted into the environment. The area illuminated by the lighting unit, for example when the lighting unit is employed as a headlight, is large. At the same time, only a small space is required for the lighting unit as a result of the redirection of the light rays. Moreover, the light source can be mounted in an easily accessible location on the lighting unit.

The light source can be a light-emitting diode. Light-emitting diodes are luminescence diodes that are used as complete units with integrated optical waveguide and light distribution devices, for example in motor vehicles. The light-emitting diodes can be implemented as individual light sources, but multiple light-emitting diodes can also be combined into a unit, for example a taillight unit. In such a light-emitting diode unit that is a design element of the vehicle, the light-emitting diodes can, for example, be cast together.

The reflector can, for example, be flat, curved in one or more axes, parabolic or paraboloidal. Parallel light rays striking the reflector intersect at a focal line in the case of a parabolic reflector, while in the case of a paraboloidal reflector they intersect at a focal point.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
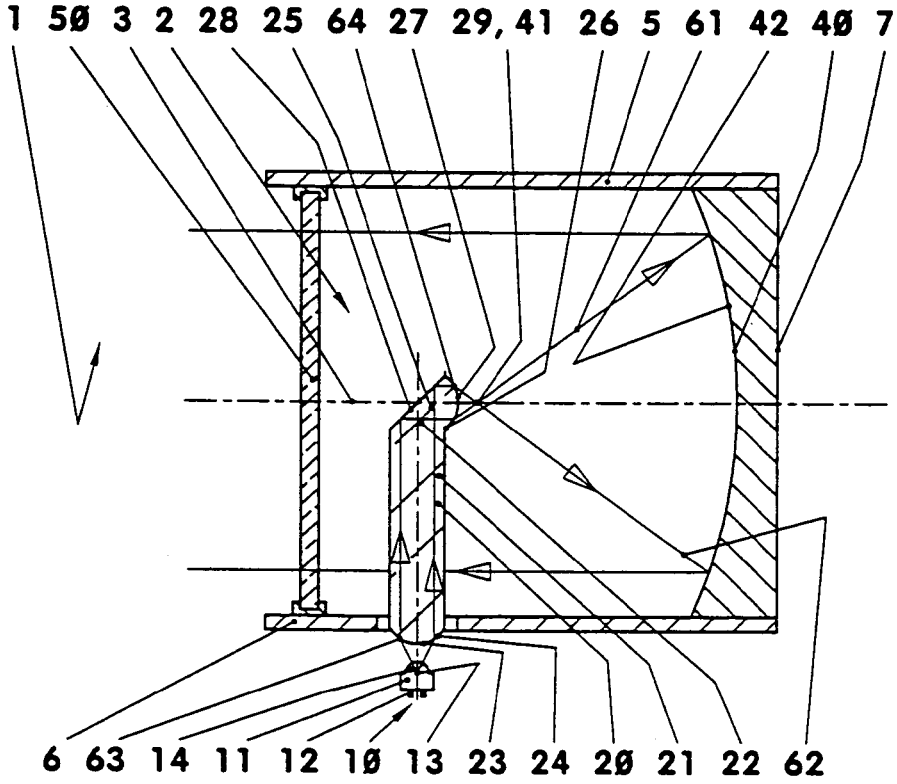
FIG. 1 is a lighting unit with externally located light source.
Figure 2:
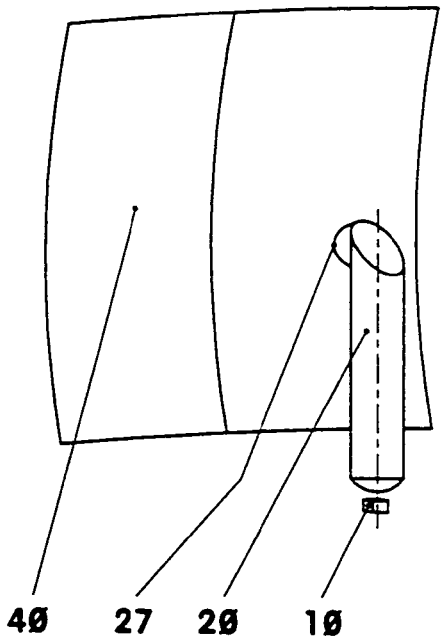
FIG. 2 is a lighting unit from FIG. 1 without housing.

FIGS. 1 and 2 show a lighting unit 1, for example a headlight for a motor vehicle (not shown). The lighting unit 1 includes a housing 2 on which are arranged a light source 10, an optical waveguide 20, a reflector 40 and a diffusion plate 50. The optical waveguide 20 that follows the light source 10 radiates the light emitted by the light source 10 toward the reflector 40, and the reflector 40 reflects the light through the diffusion plate 50 into the environment.

The length of the lighting unit 1 corresponds approximately to its height. Its width perpendicular to the plane of the drawing in FIG. 1 is approximately 80% of its length; compared with FIG. 2.

The light source 10 is, for example, attached to the outside of the housing base 6, in a manner not shown in detail in FIG. 1. It is a light-emitting diode, for example. This consists of electronic components, e.g. a light-emitting chip 13, a base 11 and at least two contacts 12 connected to the chip 13. At least the light-emitting chip 13 is enclosed by an electronics housing 14 that faces in the direction of the housing base 6.

In addition, in a manner not shown in detail in FIG. 1, the optical waveguide 20 is attached to the housing base 6. The optical waveguide 20 is a rod-shaped transparent glass or plastic body, made for example of PMMA or PMMI, which projects into the housing 2 from outside. It has a cylindrical section 21 and a section that is offset 27 in the direction of the reflector 40. The length of the optical waveguide 20 is approximately five times the diameter of its cylindrical section 21. The end face of the cylindrical section 21 that projects out of the housing 2 includes a convex surface 23. Its separation from the light-emitting diode 10 is approximately one third of the diameter of the cylindrical section 21. The offset section 27 has the shape of a wedge-shaped prism 64 in the cross-sectional representation in FIG. 1. The base surface 28 of the prism 64 that lies in the plane of the drawing is a right isosceles triangle. One imaginary leg surface 22 forms the transition 26 between the cylindrical section 21 and the prism 64. The second leg surface 25 includes a convex surface 27. The hypotenuse surface 28 subtends an angle of 45 degrees with an imaginary plane tangential to the cylindrical section 21. The optical waveguide 20 is arranged in the lighting unit 1 such that the convex surface 27 is located symmetrically with respect to the horizontal center plane 3. This horizontal center plane 3 lies normal to the plane of the drawing in FIG. 1.

The reflector 40 is, for example, arranged symmetrically with respect to the horizontal center plane 3 on the inner side of an end face of the housing 2. It has the shape of a cylindrical parabolic surface that is open toward the optical waveguide 20, compare with FIG. 2. The reflector 40 thus encloses the optical waveguide 20. The distance between the focal line of the reflector 29, 41 and the reflector 40 is approximately 93% of the distance between the convex surface 27 and the reflector 40.

The surface of the reflector 40 facing the optical waveguide 20 is a reflective surface 42, which for example has a high degree of optical reflectivity. To this end, the reflector 40 can be coated over some or all of its area, for example.

The diffusion plate 50 is arranged in the housing 2 opposite the reflector 40. The diffusion plate 50 is, for example, a glass plate arranged normal to the horizontal center plane that protects the lighting unit 1 from such influences as contamination and damage.

In place of the convex surface 23, the cylindrical section 21 can also, for example, have a concave cavity in the shape of a section of a sphere. The light source 10 is then arranged at this cavity, for example.

In producing the lighting unit 1, the light-emitting diode 10 and the optical waveguide 20 can be manufactured as one piece. The light-emitting diode 10 is then molded-in in an injection mold to produce the optical waveguide 20, for example. A homogeneous body results, from which, e.g., the contacts project on one side.

In the operation of the lighting units 1 shown in FIGS. 1 and 2, light rays are emitted from the light-emitting diode 10 toward the convex surface 23 of the optical waveguide 20. The convex surface 23 acts as a converging lens through which the light rays emitted from the light-emitting diode 10 enter the optical waveguide 20. When the light rays pass from the optically less dense medium of the environment into the optically denser medium of the optical waveguide 20, the light rays are refracted toward the perpendicular at the point of incidence 24, 63. They then travel approximately parallel in the optical waveguide 20, for example. At the hypotenuse surface 28, they are incident at an angle of, for example, 45 degrees. This angle is greater than the threshold angle of total internal reflection at the interface between the optical waveguide 20 and the environment. This threshold angle is 38 degrees for PMMI and 42 degrees for PMMA, for example. The light rays striking the hypotenuse surface 28 are totally reflected at the hypotenuse surface 28 and are directed, for example, parallel to one another toward the convex surface 27. This convex surface 27 is a light transmitting surface. It acts as a converging lens. The light rays striking the convex surface 27 are refracted away from the perpendicular at the point of incidence as they cross the interface from the optically denser medium of the optical waveguide 20 to the interior space of the lighting unit 1, which for example communicates with the surrounding air. They are, for example, focused to a focal point 29, 41 and then diverge toward the reflector 40. The focal point 29, 41 of the converging lens is located, for example, on the focal line 61, 62 of the reflector 40. Light rays striking the reflector 40 are then reflected such that they are directed toward the diffusion plate 50.

When this lighting unit 1 is used, for example as a motor vehicle headlight, the street in front of the motor vehicle is illuminated uniformly and over a large area. Toward the edge, there is a gradual transition to the unilluminated area, for example due to scattered light reflected at the outer areas of the reflector.

The reflector 40 can also have nonreflective areas. In this way, for example, an asymmetrical illuminated area for the lighting unit 1 can be created.

The light transmitting surface facing the reflector 40 can also be a flat surface, a diverging lens, etc.

Figure 3:
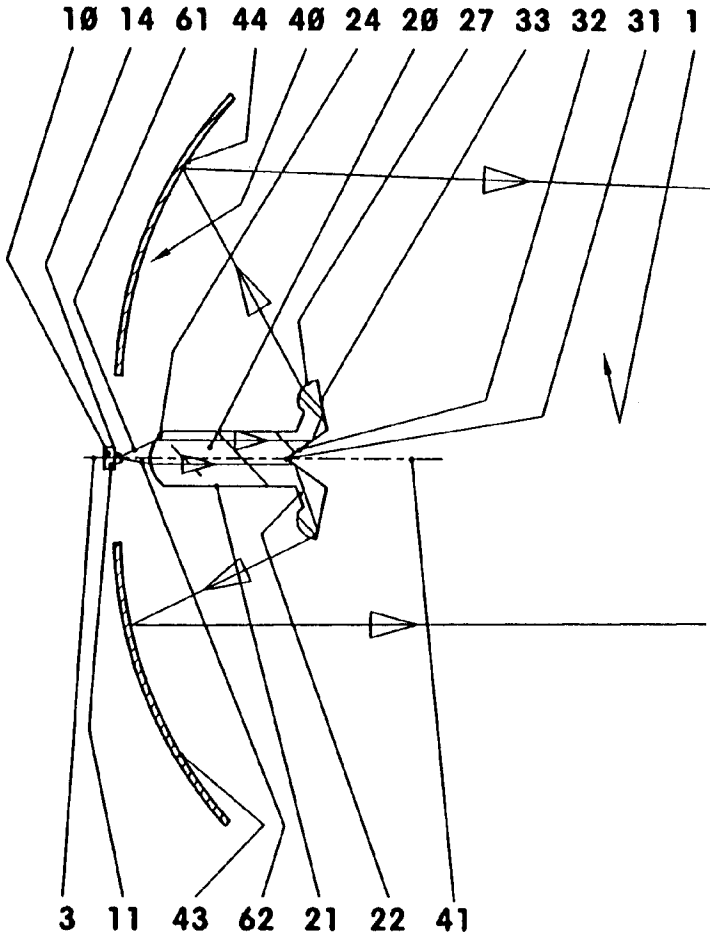
FIG. 3 is a lighting unit with a two-part reflector.

FIG. 3 shows a lighting unit 1 whose length is approximately one third of its height. This lighting unit 1 also includes a light source 10 and an optical waveguide 20 following said light source 10. The reflector 40 includes a lower reflector part 43 and an upper reflector part 44 that is a mirror image thereof, whose plane of symmetry is the horizontal center plane 3 of the lighting unit 1. Both reflector parts 43, 44 have for example the shape of sections of a cylindrical parabolic surface. The distance of the two reflector parts 43, 44 from one another is, for example, approximately one quarter of the overall height of the reflector 40.

The light source 10 is for example arranged on the horizontal center plan 3 of the lighting unit 1 such that the base 11 lies on an imaginary plane joining the two reflector parts 43, 44 and the electronics housing 14 extends in the direction of the opening of the reflector 40.

The optical waveguide 20 has a cylindrical section 21 and two offset sections 27 that are arranged as mirror images of one another relative to the horizontal center plane 3 of the lighting unit 1. The two sections 43, 44 have a prism-shaped cross-section as projected onto the plane of the drawing in FIG. 3. They are separated from one another by a horizontal groove 31. The length of the offset sections 27 is, for example, approximately half the length of the optical waveguide 20. The offset sections 27 have two outer surfaces 32, 33 which together enclose an obtuse angle. Both the light transmission surface 32 facing the light source 10 and the light transmission surface 33 facing the reflector 40 are convex surfaces which act as converging lenses. Together, the surfaces of the optical waveguide 20 facing the groove 31 enclose an angle of approximately 90 degrees. The optical waveguide 20 is arranged with respect to the reflector 40 such that, for example, the distance from the light transmission surfaces 32, 33 to the reflector 40 is less than the distance from the reflector 40 to its focal line 41.

In the operation of the lighting unit 1, the light rays 61, 62 emitted from the light source 10 pass through the converging lens 24 into the optical waveguide 20. They are totally internally reflected twice in the offset sections 27 at the outer surfaces 32, 33 and emerge from the converging lenses in the direction of the reflector 40. Upon emerging from the optical waveguide 20 through the light transmitting surfaces 32, 33, the light rays 61, 62 are refracted away from the perpendicular. After reflection at the reflector 40, they are then radiated toward the diffusion plate not shown here toward the environment.

The area illuminated by this lighting unit 1 has two bright areas, between which lies a darker central region which, for example, lies parallel to the front edge of the motor vehicle.

The two offset sections 27 of the optical waveguide 20, and/or the two reflector parts 43, 44 can also have different shapes. Thus, for example, the upper reflector part 44 can have a greater curvature than the lower reflector part 43. The light rays 61, 62 striking the reflector 40 are then deflected downward, for example. The field illuminated on the street is then asymmetrical, for example.

In an elongated embodiment of the offset sections 27, the two sections extend further toward the lower reflector part 43 or the upper reflector part 44, and the installation length of the lighting unit 1 can be shortened and/or the radius of curvature of the reflector 40 can be increased. In this way, for example, it is possible to build an extremely short headlight.

Figure 4:
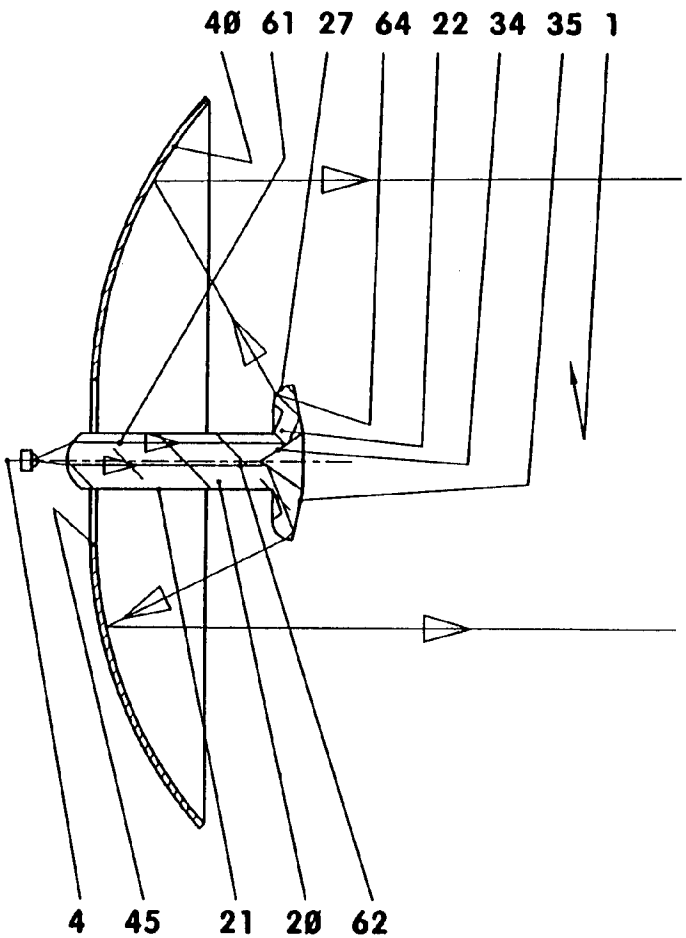
FIG. 4 is a lighting unit with a paraboloidal reflector.
Figure 5:
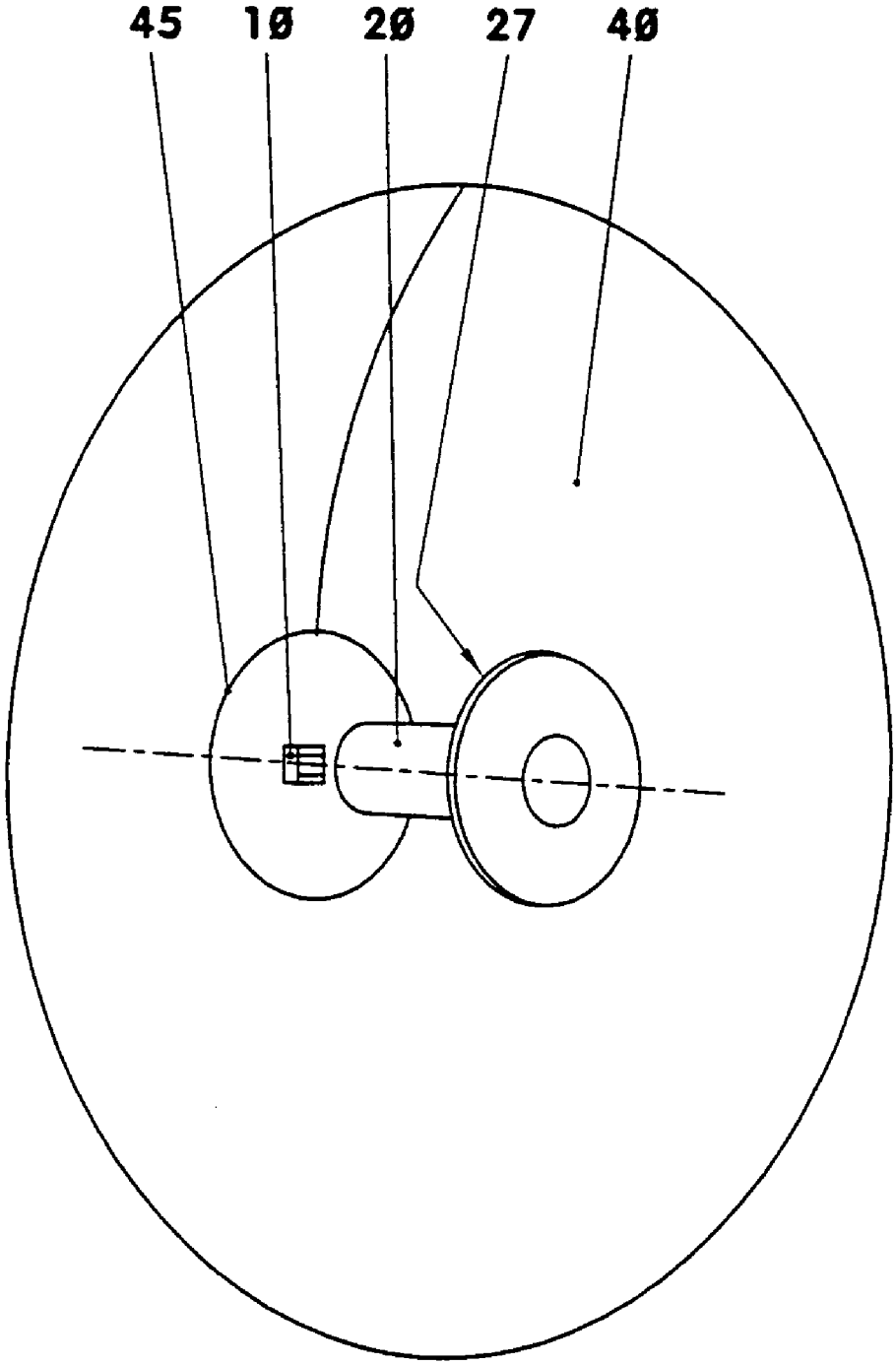
FIG. 5 is a front view of the lighting unit from FIG. 4.

FIGS. 4 and 5 show a lighting unit whose reflector 40 has the shape of a paraboloid of rotation. The length of this lighting unit 1 is approximately 40% of its diameter. The reflector 40 has a central hole 45 whose diameter is approximately one quarter of the diameter of the reflector 40. The optical waveguide 20 extends through this hole 45 into the reflector 40. The light source 10 is, for example, arranged outside an imaginary plane that closes the hole 45 in the reflector 40. The light source 10 has, for example, a high light intensity and is cooled by a cooling device to remove heat. It is easily accessible for maintenance and replacement.

The optical waveguide 20 is rotationally symmetrical about the center line 4 of the lighting unit 1. It includes a cylindrical section 21 and an offset section 27. The offset section 27 has two mutually concentric end faces 34, 35 facing away from the reflector 40, which together enclose an obtuse angle. The inner end face 34, whose diameter corresponds to the diameter of the cylindrical section 21, has the shape of the tip of an obtuse cone. It is mirror-finished, for example.

The side 64 of the offset section 27 facing the reflector in FIGS. 4 and 5 is the emergent surface. This is an annular surface 64 that is domed toward the reflector.

Light rays 61, 62 emitted by the light source 10 are refracted on passing through the converging lens such that, for example, they are directed parallel to one another within the optical waveguide 20. They are reflected at the inner end face 34 and are refracted away from the perpendicular at the point of incidence at the light transmitting surface 64. When they strike the reflector 40, the light rays 61, 62 are redirected and radiated into the environment.

The area illuminated by this lighting unit 1 is large and has an approximately uniform brightness. Of course, the shape of the illuminated area can be altered by the shape of the reflector 40, the shape and position of the optical waveguide 20, etc. Moreover, additional areas can be provided in the reflector 40 that are, for example, raised toward the optical waveguide 20. In this way, for example, individual portions of the illuminated area can be more intensely illuminated, for example to mark the lateral edges of the motor vehicle.

The optical waveguide 20 can also have a section that is conical, pyramidal, arched, etc., instead of a cylindrical section 21. Within this section, the light emitted by the light source 10 can then be totally internally reflected one or more times, or can, for example, be reflected at an outer surface 35 that is mirror-finished in certain areas.

The surface of the optical waveguide 20 can also be completely mirror-finished except for the light transmitting surfaces.

Multiple light sources 10, multiple optical waveguides 23 and/or one or more reflectors 40 can be arranged in one lighting unit 1. In this way, for example, a large area in front of a vehicle can be illuminated.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A lighting unit having a centerplane comprising:

at least one light source;

at least one reflector;

at least one optical waveguide following the at least one light source, said optical waveguide having a convex surface adjacent the light source and at least one convex surface facing the reflector; and wherein said at least one convex surface facing the reflector is located symmetrically with respect to said centerplane.

2. The lighting unit in accordance with claim 1, wherein the optical waveguide is at least partially enclosed by the reflector.

3. The lighting unit in accordance with claim 1, wherein the light source is not enclosed by the reflector.

4. The lighting unit in accordance with claim 1, wherein the light source is a light-emitting diode.

5. The lighting unit in accordance with claim 4, wherein said optical waveguide and said at least one light source are of unitary construction.

6. The lighting unit in accordance with claim 1, wherein the reflector has the shape of a paraboloid of rotation.

7. The lighting unit in accordance with claim 1, wherein said convex surface includes at least a portion of a converging lens.

8. The lighting unit in accordance with claim 1, wherein the optical waveguide has a surface that is mirror-finished at least in certain areas other than the light transmission surfaces.

9. The lighting unit in accordance with claim 1, wherein the reflector has at least one nonreflective area.

10. The lighting unit in accordance with claim 1, wherein the reflector has at least one area that is raised toward the optical waveguide.

11. A lighting unit having a centerplane, comprising:

at least one light source having a base;

an optical waveguide following said at least one light source, said optical waveguide having a cylindrical section and two offset sections having outer surfaces which form an obtuse angle with respect to each other;

a reflector having a lower reflector part and an upper reflector part, and an imaginary plane joining said lower reflector part and said upper reflector part; and wherein said at least one light source is arranged on said centerplane such that said base of said at least one light source lies in said imaginary plane joining said upper reflector part and said lower reflector part.

12. A lighting unit, comprising;

a reflector having a hole located in a centerline of said reflector;

an optical waveguide having a centerline, a cylindrical section, and an offset section having two mutually concentric end faces forming an obtuse angle with respect to each other, said optical waveguide extending through said central hole into said reflector, and wherein said mutually concentric end faces form an obtuse angle, and wherein said optical waveguide is rotationally symmetrical about said centerline of said reflector.

* * * * *